US006357331B1

(12) United States Patent
Dionne

(10) Patent No.: US 6,357,331 B1
(45) Date of Patent: Mar. 19, 2002

(54) TWO-PIECE BARREL FOR LOW-ENERGY TRAINING AMMUNITION

(75) Inventor: Sylvain Dionne, Mirabel (CA)

(73) Assignee: SNC Technologies Inc. (CA)

( * ) Notice: Subject to any disclaimer, the term of this patent is extended or adjusted under 35 U.S.C. 154(b) by 0 days.

(21) Appl. No.: 09/553,618

(22) Filed: Apr. 20, 2000

(51) Int. Cl.[7] ..... F41A 21/10

(52) U.S. Cl. ..... 89/29; 89/194; 89/162; 42/77

(58) Field of Search ..... 89/194, 29, 162; 42/77, 75.02

(56) References Cited

U.S. PATENT DOCUMENTS 2,736,118 A * 2/1956 Clarkson et al.
2,736,119 A * 2/1956 Clarkson et al.
3,842,527 A * 10/1974 Low
4,228,606 A * 10/1980 Casull
4,316,339 A * 2/1982 Herriot
4,608,909 A * 9/1986 Peters
4,707,942 A * 11/1987 Peters
4,833,810 A * 5/1989 Domian
4,920,679 A * 5/1990 Sarles et al.
5,305,678 A * 4/1994 Talbot et al.
5,585,589 A * 12/1996 Leiter
5,675,106 A * 10/1997 Leiter
5,983,773 A * 11/1999 Dionne

* cited by examiner

*Primary Examiner*—Michael J. Carone
*Assistant Examiner*—Troy Chambers
(74) *Attorney, Agent, or Firm*—David J. French

(57) ABSTRACT

A conversion kit for a recoil-operating automatic pistol to convert it to direct blow-back operation utilizes a two piece barrel having chamber and muzzle portions that may be threaded together. The chamber portion is first installed on the receiver by insertion through the injection port, and the muzzle-piece is then threaded to the chamber-piece to complete the assembly of the barrel.

5 Claims, 8 Drawing Sheets

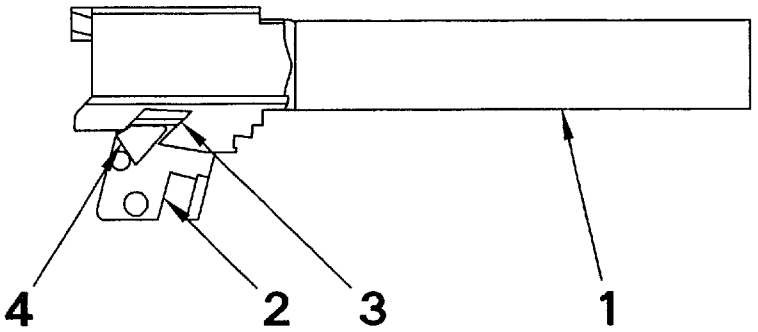
FIGURE 1 - PRIOR ART
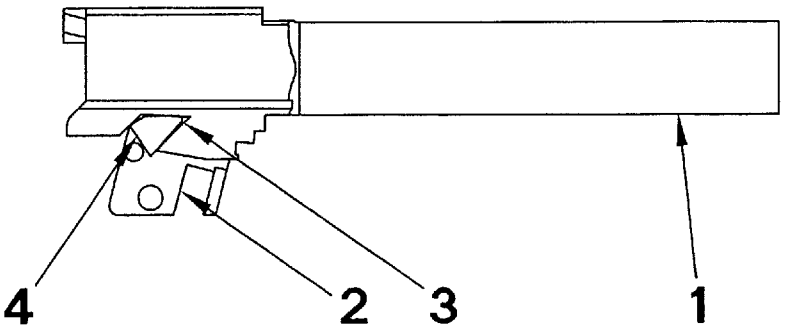
FIGURE 2 - PRIOR ART

TWO-PIECE BARREL FOR LOW-ENERGY TRAINING AMMUNITION

FIELD OF THE INVENTION

This invention relates to the field of firearms and provisions for modifying semi-automatic firearms for training purposes. In particular, it relates to the assembly of a replacement or "training" barrel into firearms that have been modified to fire low-energy ammunition in an unrestrained, blow-back mode.

BACKGROUND TO THE INVENTION

In military and police firearms applications almost all of the ammunition consumed is used in training. For some training purposes, however, normal ammunition is not appropriate. An alternative type of known training ammunition, represented by U.S. Pat. No. 5,359,937 (adopted herein by reference), fires a low-mass projectile relying on a special, low-energy cartridge designed to provide cycling of suitably modified, recoil-operated automatic and semi-automatic weapons.

An advantage of the low-energy training ammunition is that it has a shorter range and lower penetration capacity than standard ammunition. This permits use of smaller, less secure firing ranges as training facilities. If standard ammunition were accidentally employed in these facilities, unexpected dangers would arise from the increased striking power and range of standard ammunition.

The low-energy cartridge represented by U.S. Pat. No. 5,359,937, in combination with a substitute training barrel, allows normal recoil and cartridge case ejection through a blow-back action. By allowing the firing of appropriate marking cartridges, this system provides for effective close-range, force-on-force training. This system enhances the realism and training value of interactive scenario tactical training because it allows trainees to use their actual service weapons under conditions of greater safety.

When firing standard ammunition with its abundant associated energy many weapons, particularly pistols, lock the barrel to the slide for a portion of the initial recoil. Thus both the barrel and the slide in such weapons move rearwardly together for a period long enough for the projectile to exit the barrel muzzle while the breech is still closed. This allows the chamber pressure to drop before the breach opens to extract and eject the spent cartridge case. Upon unlocking, the slide of these normal weapons continues its rearward travel while the barrel stops in the proper position to receive the next round from the magazine. This next round is then fully chambered by the slide as it returns to its in-battery position.

With a training barrel it is necessary to omit this barrel locking mechanism and, by so doing, the recoil action becomes a pure or direct blow-back of the slide only. This must be done because there is insufficient energy in low-energy training cartridges to precipitate sufficient recoil to unlock the barrel and the slide in their standard configurations.

It may also be necessary to make further modifications to the training barrel, such as by extending the feed ramp, to ensure reliable functioning of the training weapon. As a result, the external geometry of the training barrel may preclude its assembly into the slide and/or receiver without modification to one or both of said slide and said receiver. This is not acceptable because it would render said slide and/or said receiver unusable for subsequent firing of standard service ammunition.

It is, therefore, an objective of this invention to provide a conversion barrel system for this class of training firearm that will allow quick and easy assembly of the training barrel without modification to either the receiver or the slide.

This training barrel allows the weapon to operate with low-energy ammunition. It may also be of a caliber that will exclude operation with standard ammunition. It is a further object to ensure that the weapon can be rapidly reconverted to fire live ammunition again by removing said training barrel and reinstalling said service barrel.

The invention in its general form will first be described, and then its implementation in terms of specific embodiments will be detailed with reference to the drawings following hereafter. These embodiments are intended to demonstrate the principal of the invention and the manner of its implementation. The invention in its broadest and more specific forms will be further described, and defined, in each of the individual claims which conclude this specification.

SUMMARY OF THE INVENTION

According to the invention an automatic firearm or pistol with a receiver and a slide containing an ejection port that normally operates by barrel recoil and a barrel locking mechanism is modified to operate by direct blow-back operation while maintaining the integrity of the standard slide and standard receiver by insertion of a training barrel. A training barrel of the type addressed by this invention is modified, in part, from the configuration of a standard barrel, by removing the locking mechanism. This allows that the barrel and the slide are no longer held together for the first portion of the recoil cycle. Thus, upon firing a round fitted into the barrel chamber, the slide is free to move rearwards from its in-battery position unencumbered by the barrel. At the same time the training barrel does not move significantly during the firing cycle. By this arrangement maximum energy is transferred to the slide, thereby contributing to reliable weapon cycling.

This conversion is effected by using a training barrel fabricated in two pieces:

(1) a chamber-piece containing a receiver engagement portion that serves as a mounting post and a chamber-piece coupling means at its forward end; and (2) a muzzle-piece having a complementary coupling means at its chamber end for engagement with the chamber-piece, wherein the chamber-piece is dimensioned to be installed on the receiver by being passed through the ejection port. For this purpose the length of the chamber-piece may conveniently not exceed the length of the ejection port although this is not essential. Preferably the chamber-piece coupling means is positioned adjacent the chamber, permitting a round when chambered to protrude into the bore of the muzzle-piece. A threaded coupling means is preferred, but other coupling means, such as a bayonet-type may be employed.

The muzzle-piece contains all or the greater part of the barrel bore. Preferably, the chamber portion of the chamber-piece, and the chamber piece itself, are of a length that will permit a round to extend to penetrate into the barrel bore when chambered in the chamber.

The method of the invention comprises the assembly of a standard slide onto a standard receiver without the training barrel being present. The training barrel is provided in two parts: a chamber-piece and a muzzle-piece which may be coupled together. The chamber-piece is lowered from above and fitted onto a seat in the form of a locking block present within the receiver by passing it through the ejection port of the slide. The barrel portion or muzzle-piece of the training barrel is then inserted through the muzzle end of the slide and attached to the chamber-piece as by threading it in place. A mounting post carried by the chamber-piece keys into the locking block and, with the muzzle-piece in place, the entire, composite training barrel is substantially fixed to the receiver (subject only to an insignificant amount of "play").

The foregoing summarizes the principal features of the invention and some of its optional aspects. The invention may be further understood by the description of the preferred embodiments, in conjunction with the drawings, which now follow.

SUMMARY OF THE FIGURES

FIG. 1 is a side view of a standard, prior art, service barrel for a pistol fitted to the locking block, which is an integral part of the receiver (not shown), when the weapon is in-battery and ready to fire.

FIG. 2 is the same view as FIG. 1 except that it shows the barrel displaced rearward and downward, arrested by the locking block, in its case-ejection and cartridge-feeding position after the weapon has been fired, but before the return of the slide carries it forward to its in-battery position.

DESCRIPTION OF THE PREFERRED EMBODIMENT

Figure 3:
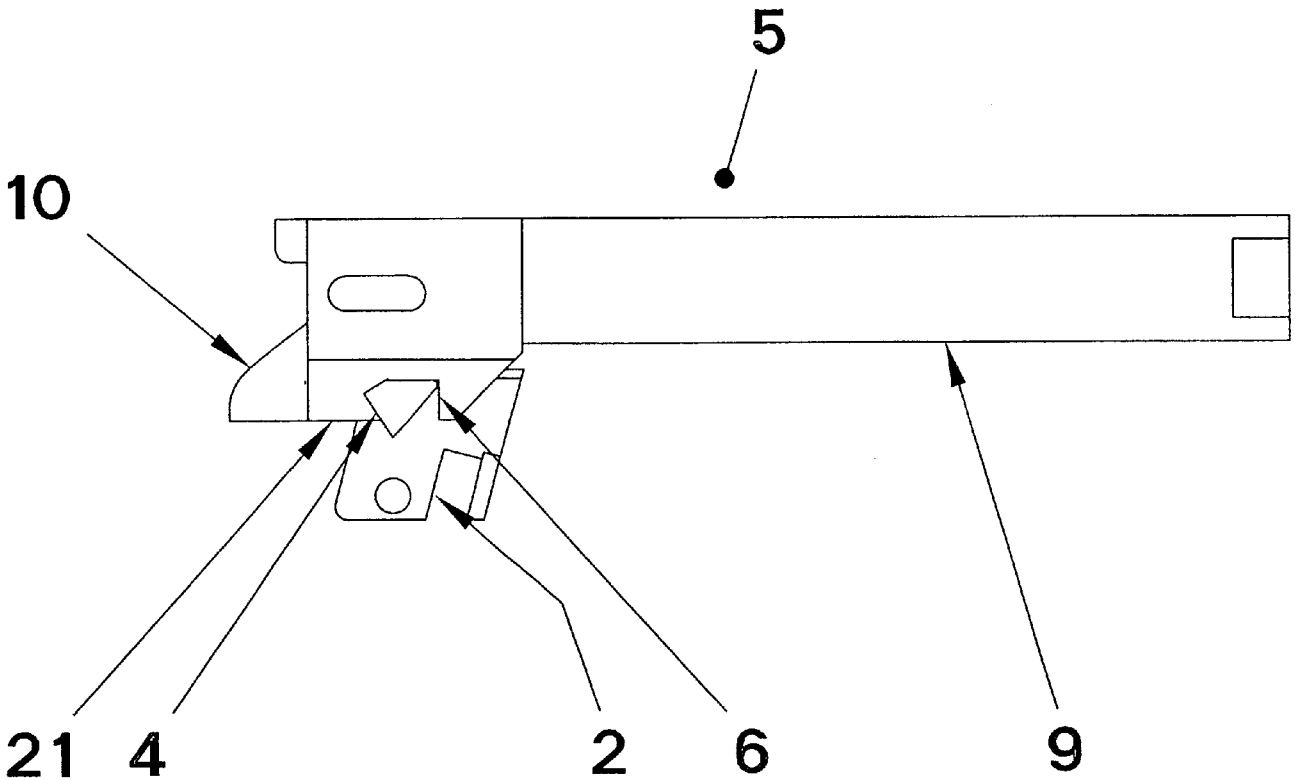
FIG. 3 depicts a training barrel according to the invention assembled in the receiver whereby it is restrained from significant longitudinal (forward or backward) movement by being fitted into the locking block of the receiver of the same weapon depicted in FIGS. 1 and 2.

As background to the problem, a standard prior art service barrel 1 is shown in FIGS. 1 and 2 mounted on the locking block 2 of the receiver of a standard pistol (other details of the receiver and pistol are not shown). The position of the barrel 1 with respect to the locking block 2 is, in FIG. 1, as it would be if the pistol were in-battery and ready to fire. The extent of movement of the barrel 1 with respect to the locking black 2 during firing is shown in FIG. 2, where it can be seen that the barrel 1 has moved rearwards and downwards with respect to the locking block 2. The extent of such movement is governed by the respective shapes of groove 3 and cam 4 over which it reciprocates.

In FIG. 3 the training barrel 5 of the invention is shown, constrained from meaningful movement with respect to locking block 2 by the shape of the training groove 6 in chamber-piece mounting post 21 which fits over cam 4 of locking block 2. This change, along with the addition of extended feed ramp 10, creates the problem of the invention in that a unitary training barrel 5 cannot be assembled, for example, into a Glock 17 pistol being converted to fire low-energy ammunition, following the same procedures as for the insertion of a standard, prior art barrel into the weapon.

Figure 4:
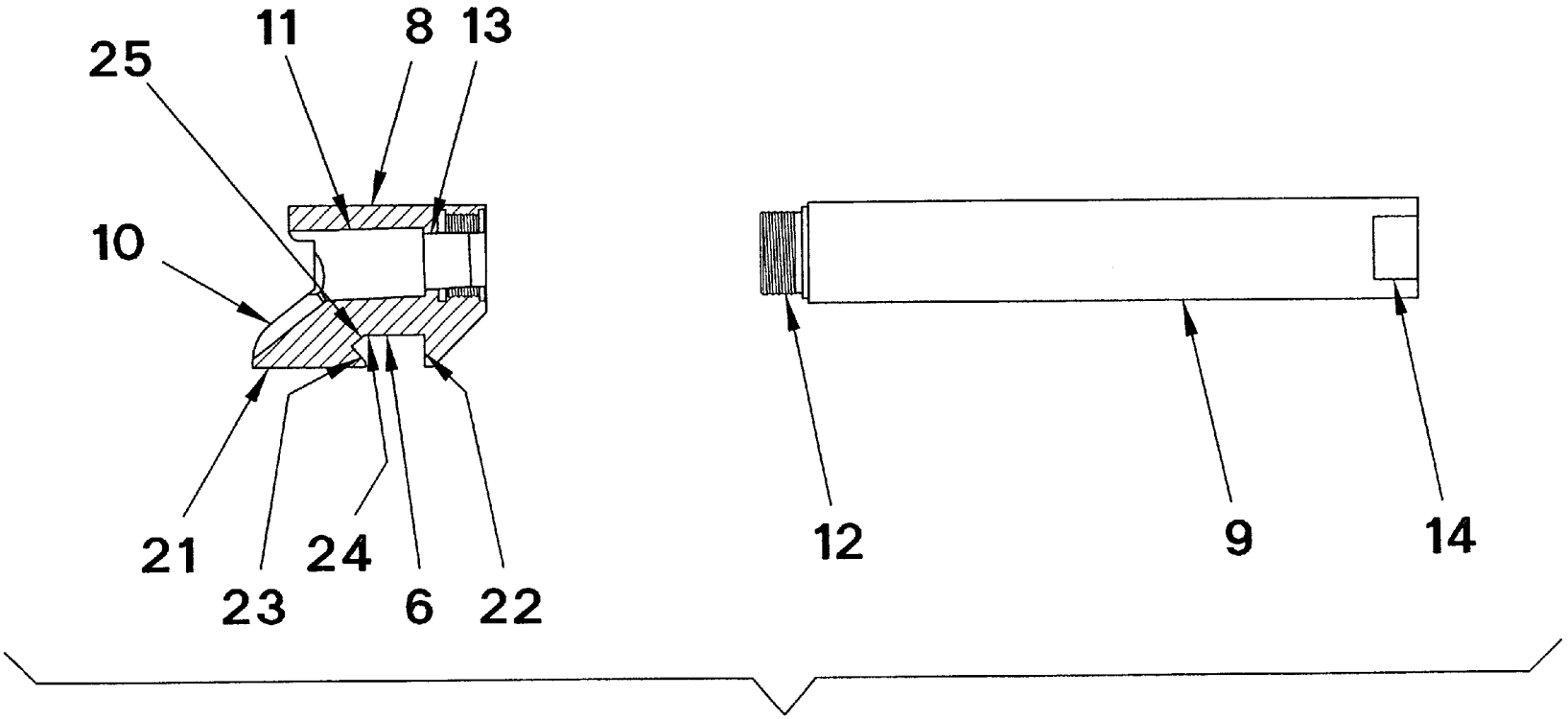
FIG. 4 is an exploded face view of the training barrel of FIG. 3 showing its chamber and muzzle-pieces, the former in cross-section.

This problem is overcome by fabricating the training barrel in two pieces, as illustrated in FIG. 4. In this figure, training barrel 5 is shown broken into two distinct pieces, chamber-piece 8 and muzzle-piece 9. In addition to containing the internally rifled bore 26 of the barrel (shown in FIG. 5), muzzle-piece 9 contains male screw threads 12 at its rearward extremity, and two opposing flat grip surfaces 14 (only one shown) at its forward extremity.

Also shown in FIG. 4, chamber-piece 8 contains training groove 6 for engagement with the receiver 18, extended feed ramp 10, chamber 11, and female screw threads 13 at its forward extremity which match said male screws 12 in the muzzle-piece 9. The length of the muzzle-piece 9 is such that it can be screwed into the chamber-piece 8 using a wrench on grip surfaces 14 at the muzzle end, after insertion into the weapon, as described in the assembly procedure detailed below. The length of the chamber-piece 8 is preferably sufficiently short as to allow a round (not shown), upon being chambered, to extend into the bore 26 of the muzzle-piece 9.

Figure 5:
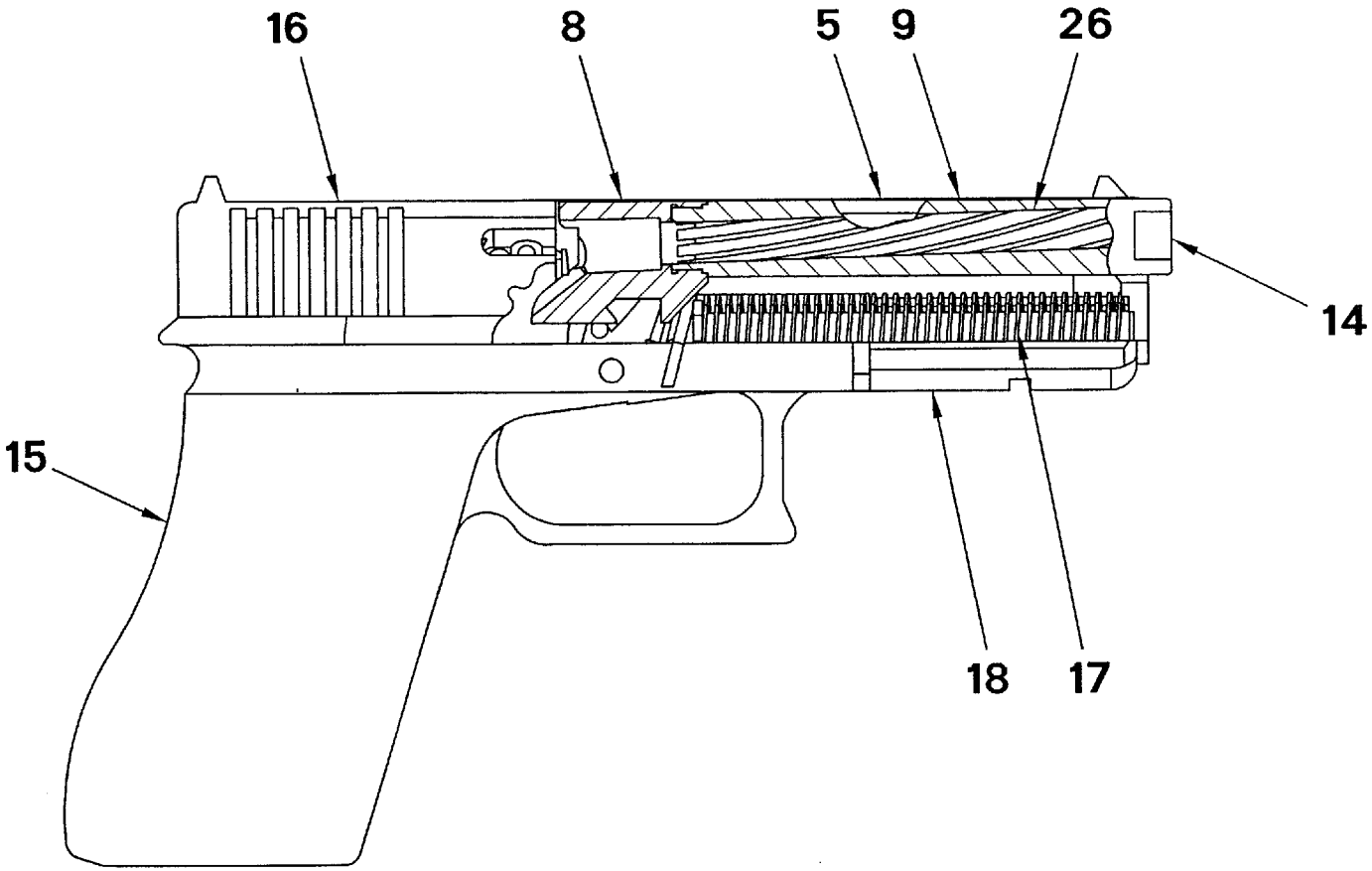
FIG. 5 shows a fully assembled training weapon, in the in-battery position, assembled according to the method of the invention; the drawing is partially cross-sectioned. In this configuration, the weapon will fire low-energy training ammunition as represented by U.S. Pat. No. 5,359,937 (ammunition not shown).
Figure 6:
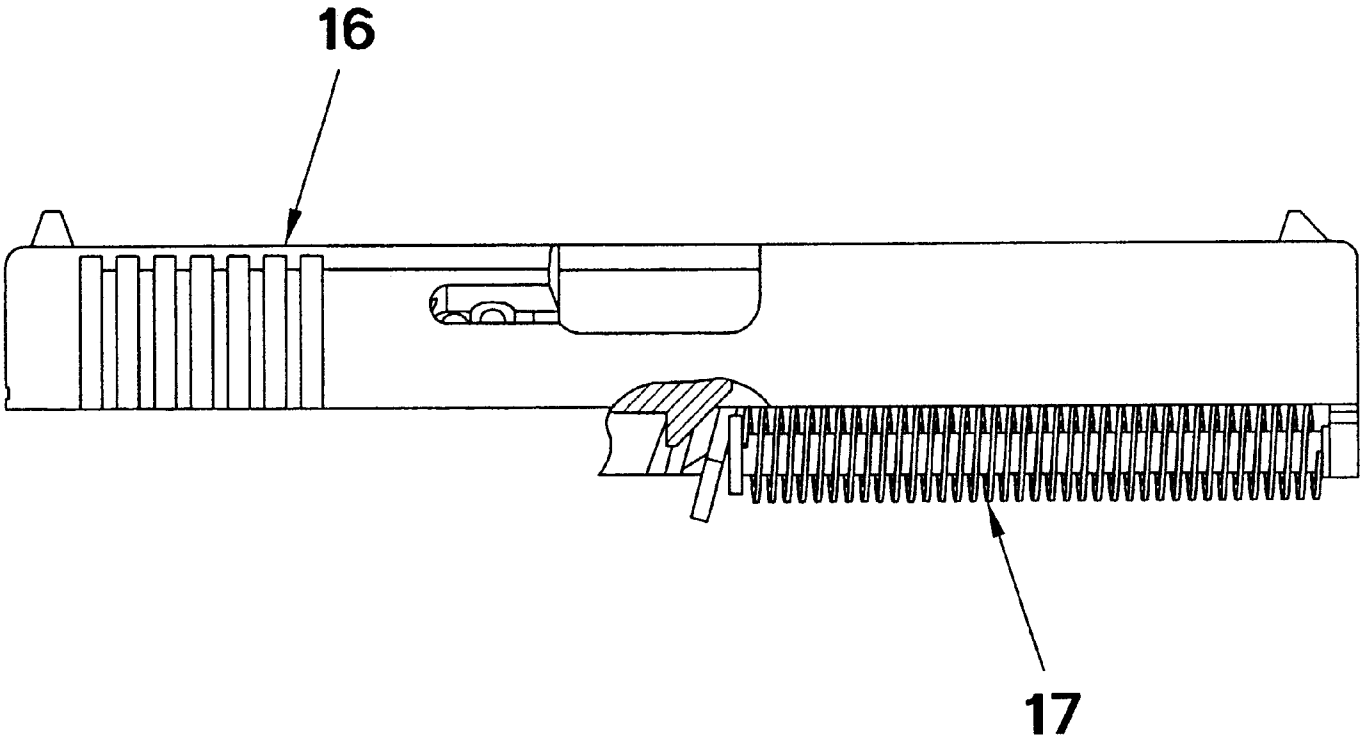
FIG. 6 is a partially cutaway side view of the slide with ejection port and recoil spring for a standard Glock 17 automatic pistol assembled without a barrel present.
Figure 7:
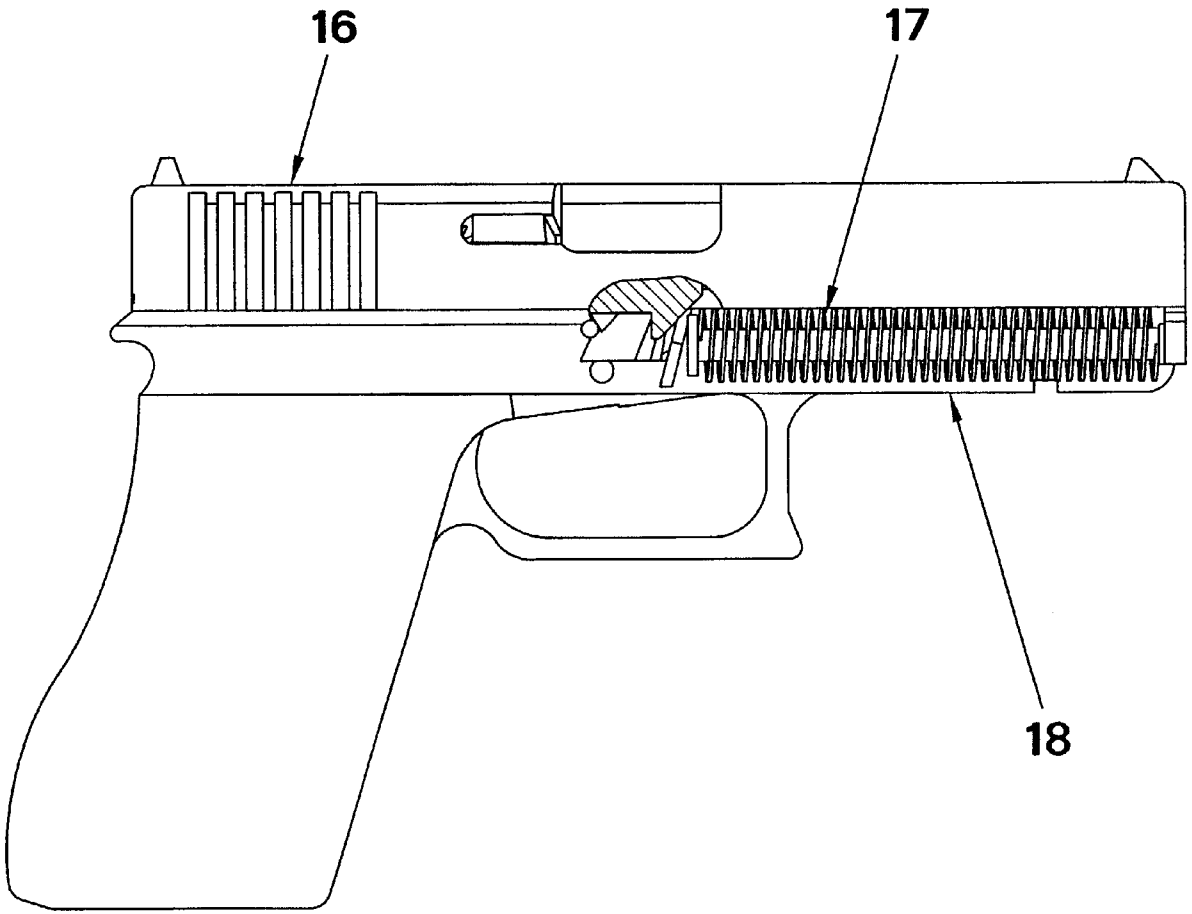
FIG. 7 is a side view of the assembly of FIG. 6 installed on the receiver.
Figure 8:
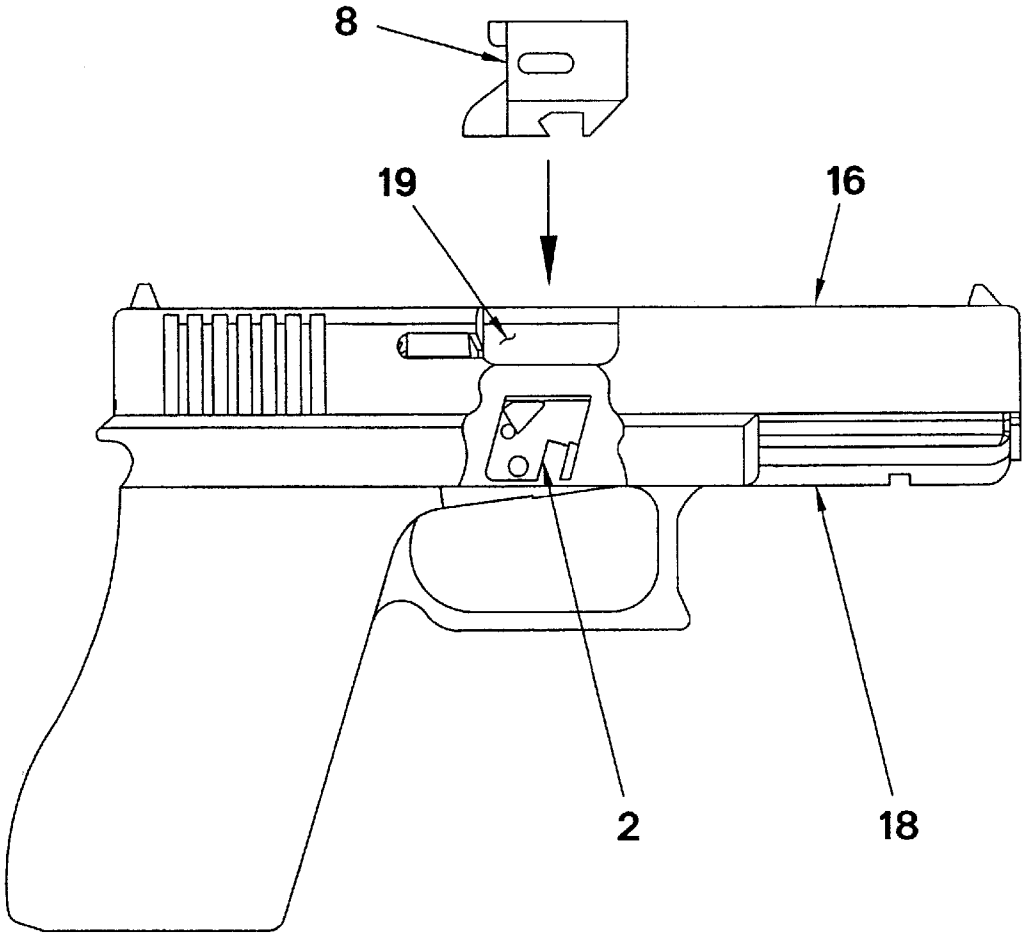
FIG. 8 is a side view of the procedure by which the chamber-piece of the two-piece training barrel of FIG. 4 is dropped through the ejection port of the slide of FIG. 6 onto the locking block of the receiver.
Figure 9:
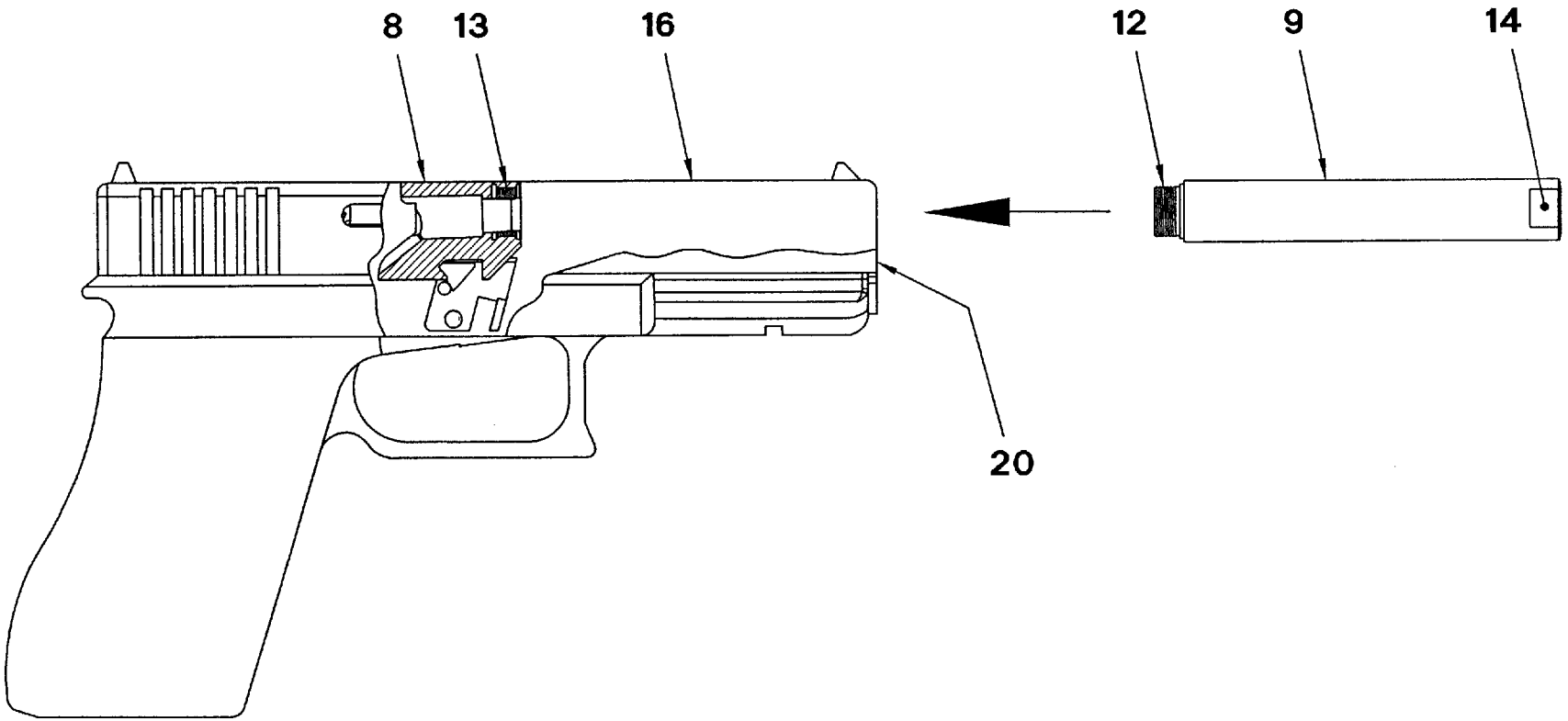
FIG. 9 shows the positioning of the chamber-piece on the locking block of the receiver in partial cutaway cross-section and the concluding step by which the muzzle-piece of the two-piece training barrel of FIG. 4 is inserted into the muzzle end of the slide so that it can be screwed into the chamber-piece once fully positioned.

A fully assembled training pistol 15 in the in-battery position is shown in FIG. 5 ready to chamber low-energy training ammunition as represented by U.S. Pat. No. 5,359,937 (ammunition not shown). It consists of standard slide 16, standard recoil spring 17, standard receiver 18, and training barrel 5 made up of chamber-piece 8 and muzzle-piece 9. This configuration can be attained by adhering to the following assembly procedure:

- Insert standard recoil spring 17 into standard slide 16, as shown in FIG. 6, according to standard assembly instructions for the weapon involved.
- Position the assembly of FIG. 6 onto standard receiver 18, as shown in FIG. 7 according to standard assembly instructions for the weapon involved.
- Insert chamber-piece 8 through ejection port 19 of slide 16, as shown in FIG. 8, and fit it over locking block 2, as illustrated in FIG. 3. For this purpose, it is desirable, but not essential, for the length of the chamber-piece not to exceed the length of the ejection port.
- Insert muzzle-piece 9 into muzzle end 20 of slide 16, as shown in FIG. 9, and push it rearward until male screw threads 12 come into contact with the female screw threads 13 of chamber-piece 8, as illustrated in FIG. 5.
- Using a wrench on grip surfaces 14, screw muzzle-piece 9 firmly into chamber-piece 8 until fully seated, as illustrated in FIG. 5.

Training groove 6 in mounting post 21 of chamber-piece 8, as shown in FIG. 4, is so shaped as to permit chamber-piece 8 to fit closely over the receiver engagement portion, cam 4 of locking block 2, as shown in FIG. 3. Once so fitted, there is only an insignificant amount of longitudinal play. The vertical front face 22 of training groove 6 restrains rearward movement and angled rear face 23, which matches the contour of cam 4, restricts forward motion. After muzzle-piece 9 is fully attached to chamber-piece 8, there can be no significant vertical motion of training barrel 5, due in part to horizontal face 24 of training groove 6, which prevents downward movement, and in part by the presence of slide 16 overlying the barrel 5, which restrains upward motion. Supplementary square groove 25, located at the rearward intersection of angled rear face 23 and horizontal face 24, is optional and is only present to facilitate machining of the piece.

Disassembly of training pistol 15, as illustrated in FIG. 5, is effected by implementing the above procedure in the reverse manner.

Many Glock-adapted two-piece training barrels have been manufactured and tested in Glock 17 training pistols assembled according to the procedure detailed above. Test firings following assembly using low-energy training ammunition, as represented by U.S. Pat. No. 5,359,937, have yielded normal ballistic results for such rounds with no ill effect on the mechanical integrity of the training barrel.

The concept of a two-piece barrel of this type, and the method of assembly of the invention, may also be applicable to other makes of potential training pistols, including the Sig PRO, Glock 19 and 22, and Walther P-99.

Conclusion

The foregoing constitutes a description of specific embodiments showing how the invention may be applied and put into use. These embodiments are only exemplary. The invention in its broadest and more specific aspects is further described and defined in the claims which follow. These claims, and the language used therein, are to be understood in terms of the variants of the invention which has been described. They are not to be restricted to such variants, but are to be read as covering the full scope of the invention as is implicit within the invention and the disclosure that has been provided herein.

The embodiments of the invention in which an exclusive property are claimed are as follows:

1. An automatic firearm having a receiver 18, a slide 16 with an ejection port 19 and a training barrel 5, said training barrel 5 comprising (1) a chamber-piece 8 having a receiver engagement portion 21 and a chamber-piece coupling means 13 at the forward end of the chamber-piece; and (2) a muzzle-piece 9 having a barrel bore 26 and a complementary coupling means at the chamber end of the muzzle-piece 9 for coupling to the chamber piece 8 characterized by the chamber-piece 8 being dimensioned to be passed through the ejection port 19 upon assembly of the firearm.

2. A firearm as in claim 1 characterized by the length of the chamber-piece 8 being less than the length of the ejection port 19.

3. A firearm as in claim 1 in combination with a cartridge comprising a round fitted into said chamber-piece 8.

4. A firearm as in claim 3 wherein the round is a low-energy training and round and the slide is free to recoil upon firing.

5. A method of assembly of a training barrel 5 into a firearm 15 having a receiver 18 and slide 16 with an ejection port wherein the training barrel 5 comprises:

(1) a chamber-piece 8 having a receiver engagement portion 21 and a chamber-piece coupling means 13 forward end of the chamber-piece; and (2) a muzzle-piece 9 having a complementary coupling means 12 at the chamber end of the muzzle-piece 9, wherein the barrel 5 is installed in the weapon by passing the chamber-piece 8 through the ejection port 19 of the slide 16 to be fitted to the receiver 18, and by of inserting the muzzle-piece through the slide to become attached to the chamber-piece by being engaged to the chamber-piece coupling means.

* * * * *